United States Patent [19]

Jernigan

[11] Patent Number: 4,467,552

[45] Date of Patent: Aug. 28, 1984

[54] BUBBLE BLOWING DEVICE

[76] Inventor: Jerry Jernigan, 227 Dink La., SE., Marietta, Ga. 30060

[21] Appl. No.: 534,607

[22] Filed: Sep. 22, 1983

[51] Int. Cl.[3] ..... A63H 33/28

[52] U.S. Cl. ..... 446/15

[58] Field of Search ..... 46/6, 7, 8, 46

[56] References Cited

U.S. PATENT DOCUMENTS 2,398,513 4/1946 Bradley ..... 46/7

2,514,009 7/1950 Raspet ..... 46/6

4,180,938 1/1980 La Fata et al. ..... 46/6

*Primary Examiner*—Mickey Yu

*Attorney, Agent, or Firm*—B. P. Fishburne, Jr.

[57] ABSTRACT

A bubble blowing toy features two bubble blowing loops connected by a common support member essentially tangent to the loops, with the loops disposed in perpendicular planes. The loops produce different types of bubbles. While one loop is being used to produce bubbles, the opposite end loop serves as a handle.

3 Claims, 4 Drawing Figures

BUBBLE BLOWING DEVICE

BACKGROUND OF THE INVENTION

The object of the present invention is to improve on that type of bubble blowing device shown in U.S. Pat. No. 4,180,938. More particularly, the present invention seeks to simplify the construction of the bubble blowing device or toy and reduce its cost of manufacturing while increasing its utility and versatility of use.

More particularly, the bubble blowing device in accordance with the present invention, in a preferred form, is constructed from a single length of plastic-coated wire which is formed to provide two types of bubble blowing heads or loops united through a common connector rod which is tangent to the loops, the latter being positioned in perpendicular planes at opposite ends of the connector rod. One bubble blowing head embodies a small ring element disposed concentrically inside of a larger ring element and produces a smaller bubble disposed freely inside of a larger bubble. The other bubble blowing head of the device embodies a single circular loop bisected by a diametrically extending rod element. This head has the capability of forming two joined bubble segments having a divider wall and roughly resembling a figure-8. The bubble blowing device can also be embodied in a molded structure.

Other features and advantages of the invention will become apparent to those skilled in the art during the course of the following description.

DETAILED DESCRIPTION

Figure 1:
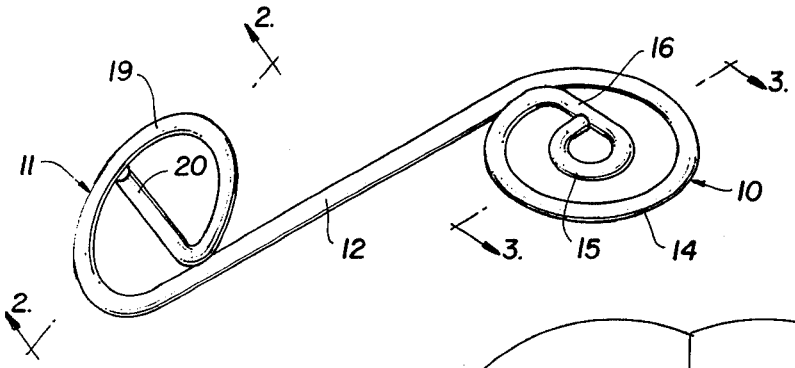
FIG. 1 is a perspective view of a bubble blowing device or toy according to a preferred embodiment of the invention.
Figure 2:
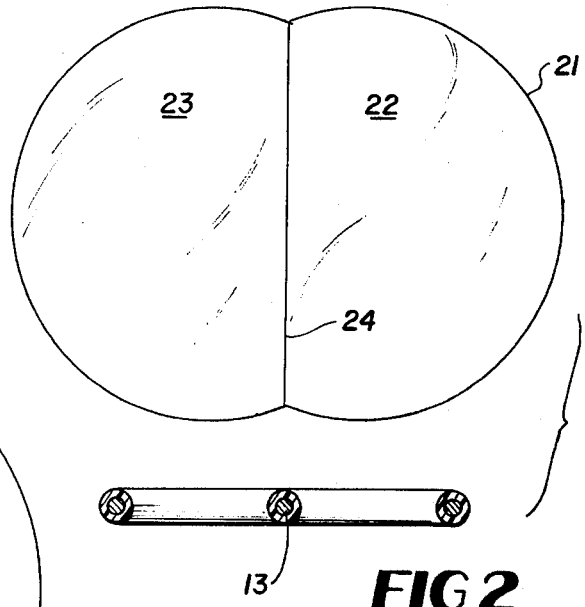
FIG. 2 is an enlarged cross sectional view taken on line 2—2 of FIG. 1.
Figure 3:
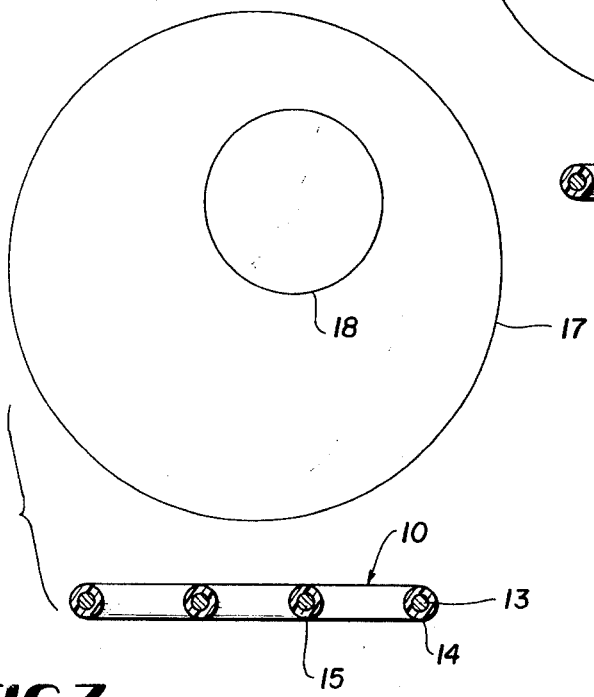
FIG. 3 is a similar view taken on line 3—3 of FIG. 1.

Referring to the drawings in detail wherein like numerals designate like parts, a bubble blowing device or toy comprises two bubble blowing heads 10 and 11 capable of independent usage for forming two types of bubbles, as will be further discussed. The two heads 10 and 11 preferably lie in perpendicular planes, are substantially circularly formed, with substantially equal outside diameters and are connected by a straight rod portion 12 which is substantially tangent to the two heads 10 and 11. Ideally, the device thus far described can be constructed from a single length of aluminum wire and the like having a plastic coating 13 enclosing the wire body of the device or toy.

The bubble blowing head 10 comprises an outer substantially circular loop 14, within which is disposed in concentrically spaced relationship a smaller loop 15 supported on a radial arm 16 carried by one end of the larger loop 14. The two loops 14 and 15 preferably occupy a common plane.

The bubble blowing head 10, when dipped into a conventional bubble blowing high surface tension liquid, produces a larger exterior bubble 17 containing an interior freely movable smaller bubble 18, the two bubbles being generated by the two concentric loops 14 and 15. Usually, more than one bubble 18 is formed.

The bubble blowing head 11 consists of a substantially circular loop 19, preferably having substantially the diameter of the loop 14 and being disposed in a plane perpendicular to the loop 14. The loop 19 is bisected by a diametrically extending rod element 20 joined to one end of the loop 19, approximately at the point of tangency with the loop connector rod 12.

The bubble blowing head 11 can produce a compound bubble 21 consisting of two joined bubble segments 22 and 23 having a divider wall 24. The bubble 21 somewhat resembles a figure-8.

When bubbles are being blown by means of one head 10 or 11, the other head of the device forms a convenient handle. The disposition of the two heads 10 and 11 in perpendicular planes facilitates holding one bubble blowing head in a plane roughly perpendicular to and across an airstream blown from the mouth of a user of the device while the other head of the device is held by the fingers. Bubbles can also be generated by either head 10 or 11 simply by waving the device as a wand through the air following dipping it into the bubble solution.

Figure 4:
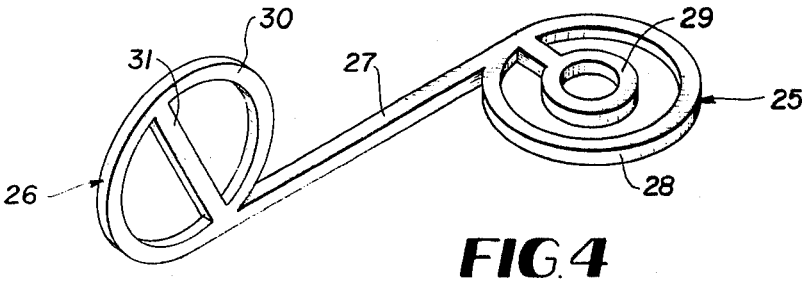
FIG. 4 is a perspective view of the device according to a second embodiment of the invention.

FIG. 4 of the drawings shows a second embodiment of the invention wherein the device is molded as a unit from plastics material instead of fabricating it from coated wire. Its construction and mode of use remain substantially as described. Two perpendicular bubble blowing heads 25 and 26 are joined tangentially by a connector rod portion 27. The head 25 comprises two concentrically spaced loops 28 and 29, while the head 26 consists of a single loop 30 having a bisecting element 31.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A bubble blowing device formed as a unit from a single continuous length of plastics coated wire, the device comprising a substantially straight elongated rod section, and a pair of substantially circular bubble forming loops carried by the opposite ends of the rod section and being substantially in tangential relationship to the rod section and lying in mutually perpendicular planes, said loops projecting bodily laterally of the rod section.

2. A bubble blowing device as defined in claim 1, and one of said loops including a loop bisecting element extending substantially diametrically thereof, the other loop comprising an outer loop portion and an interior smaller spaced substantially concentric loop within the outer loop portion and lying in a common plane therewith.

3. A bubble blowing device comprising a substantially straight elongated rod section, and a pair of approximately equal size substantially circular bubble forming loops carried by the opposite ends of the rod section and being in tangential relationship to the rod section and lying in mutually perpendicular planes, said loops extending bodily laterally of the rod section.

* * * * *